US005666674A

United States Patent [19]

Hennessy

[11] Patent Number: 5,666,674

[45] Date of Patent: Sep. 16, 1997

[54] DUMP BUCKET TOILET

[76] Inventor: Arnold Hennessy, 64 West Street, Apt. 107, Wellington, Ontario, Canada, K0K 3L0

[21] Appl. No.: 410,364

[22] Filed: Mar. 24, 1995

[51] Int. Cl.[6] ..... E03D 1/20

[52] U.S. Cl. ..... 4/365; 4/378; 4/353

[58] Field of Search ..... 4/365, 363, 415, 4/378, 324, 325, 661, 213, 353, 411; 222/160, 556

[56] References Cited

U.S. PATENT DOCUMENTS

| | | | |
|---|---|---|---|
| 221,067 | 10/1879 | Houston . | |
| 448,800 | 3/1891 | Mentel . | |
| 450,798 | 4/1891 | Scott . | |
| 546,595 | 9/1895 | Politsky . | |
| 577,021 | 2/1897 | Groszmann . | |
| 607,652 | 7/1898 | Burgin . | |
| 675,491 | 6/1901 | Mann . | |
| 728,470 | 5/1903 | Kulhanek . | |
| 901,525 | 10/1908 | Depew . | |
| 1,008,328 | 11/1911 | Hammond . | |
| 1,083,782 | 1/1914 | Von Radich . | |
| 1,265,890 | 5/1918 | Egan . | |
| 1,325,934 | 12/1919 | Egan . | |
| 2,349,015 | 5/1944 | Stalcup . | |
| 5,083,323 | 1/1992 | Cannan | 4/415 |
| 5,195,190 | 3/1993 | Nguyen-Huu | 4/415 |
| 5,325,547 | 7/1994 | Pino | 4/378 |

FOREIGN PATENT DOCUMENTS

| | | | |
|---|---|---|---|
| 24788 | of 1899 | United Kingdom | 4/365 |
| 22752 | of 1906 | United Kingdom | 4/365 |

*Primary Examiner*—Henry J. Recla
*Assistant Examiner*—Charles R. Eloshway
*Attorney, Agent, or Firm*—Freilich Hornbaker Rosen

[57] ABSTRACT

A dump bucket toilet is described, with an improved support for the bucket, a manual control that can save water, and an outlet region which efficiently directs dumped water into the toilet bowl. A support (60, FIG. 1) for the bucket has a mount portion (62) mounted on an upper portion of the toilet tank and has a largely downwardly extending support portion (100), the support portion pivotally supporting the middle of a rod (104) that extends between the opposite sides of the bucket. A manually operable control (152, FIG. 5) is operable in a full-flush mode to pivot the bucket by a first angle to a full release position to release almost all bucket water, the control being operable in a second partial-flush mode to pivot the bucket by a smaller second angle to release about half of the bucket water. A funnel (24, FIG. 1) extends at least four inches above the bottom of the container, with the funnel walls forming an included angle of about 14° to efficiently direct the dumped water. In between flushings, water fills the bottom of the container up to the top of the funnel.

14 Claims, 4 Drawing Sheets

R
I
F
O
10
12
14
16
20
22
24
26
28
30
32
34
36
40
42
60
62
64
66
70
72
76
80
82
84
86
89
90
91
92
93
94
96
100
102
104
106
110
112
114
116
118
120
122
124
126
130
132
134
210
212

DUMP BUCKET TOILET

BACKGROUND OF THE INVENTION

A large majority of toilets in present use include a tank that holds considerable water (e.g. 5 gallons) between flushings, with a flush valve at the bottom of the tank. To begin a flushing the flush valve is lifted off a flush valve seat and at least a portion of the stored water is released to flow to the toilet bowl. One type of recent water saver toilet includes a timed flush valve which closes after perhaps one third of the topmost portion of the stored water is released, to limit water usage (to e.g. 1.6 gallons). However, if the special timed valve is replaced by a conventional valve, then almost all of the stored water will be released, and there will be not a saving in water usage. The timed flush valve is not as reliable as conventional flush valves, and poses a maintenance problem.

Applicant has been considering the use of a dump bucket toilet, which is described in several old patents, but which applicant has not seen in use. Such patents describe a bucket that holds water between flushings. At the beginning of a flushing, the bucket is tipped, and it releases substantially all of its water to flow out of a continually-open outlet at the bottom of the tank to the toilet bowl. Structures for pivotally supporting the dump bucket have been complex, require holes in the water tank, which is usually a ceramic (fired clay) molded item, and/or are not reliable. It would be desirable if a very simple support were available to pivotally support a pivoting bucket in a tank, especially a tank of the conventional ceramic type. It also would be desirable if water released to the toilet bowl were released with a considerable pressure or head, and along a conduit that guided the water to produce as rapid a flow as possible. It also would be desirable if even more water could be saved when flushing only liquid waste in the toilet bowl.

SUMMARY OF THE INVENTION

In accordance with one embodiment of the present invention, a dump bucket toilet and an apparatus for use therein are provided which simplify the assembly of the toilet, which permit even greater water savings when possible, and which efficiently direct water towards the toilet bowl. The toilet includes a container such as a toilet tank having opposite container walls that each has a top edge with an upwardly-facing surface. A support that pivotally supports the bucket, has a mount portion with opposite ends that each rest on one of the upwardly-facing surfaces at the top edge of a corresponding container wall. This allows the support with the bucket pivotally mounted thereon, to be mounted in a tank by merely laying the support on the top edge of the tank. The bucket includes a rod extending between front and rear walls of the bucket, and the support includes a member lying halfway between the bucket sides and pivotally supporting the middle of the rod.

Greater water savings are possible by providing a manually operable control which is operable to either a full flush mode or a partial flush mode. In the full flush mode, the control allows the bucket to pivot from an initial position to a full flush position at which almost all of the water originally in the bucket is released. When the control is operated in the partial flush mode, it positions a stop in the path of the pivoting bucket, to prevent the bucket from pivoting past a partial flush position at which only about half of the water originally in the bucket is released. This allows water to be saved when the bowl contains only liquid waste.

A funnel lies at the bottom of the tank and extends at least four inches above the tank bottom. Water fills the bottom of the tank up to the top of the funnel. The funnel inside walls form an included angle of about 14°, which efficiently directs suddenly dumped water to the toilet bowl.

The novel features of the invention are set forth with particularity in the appended claims. The invention will be best understood from the following description when read in conjunction with the accompanying drawings.

DESCRIPTION OF THE PREFERRED EMBODIMENTS

Figures 1, 1A, 1B:
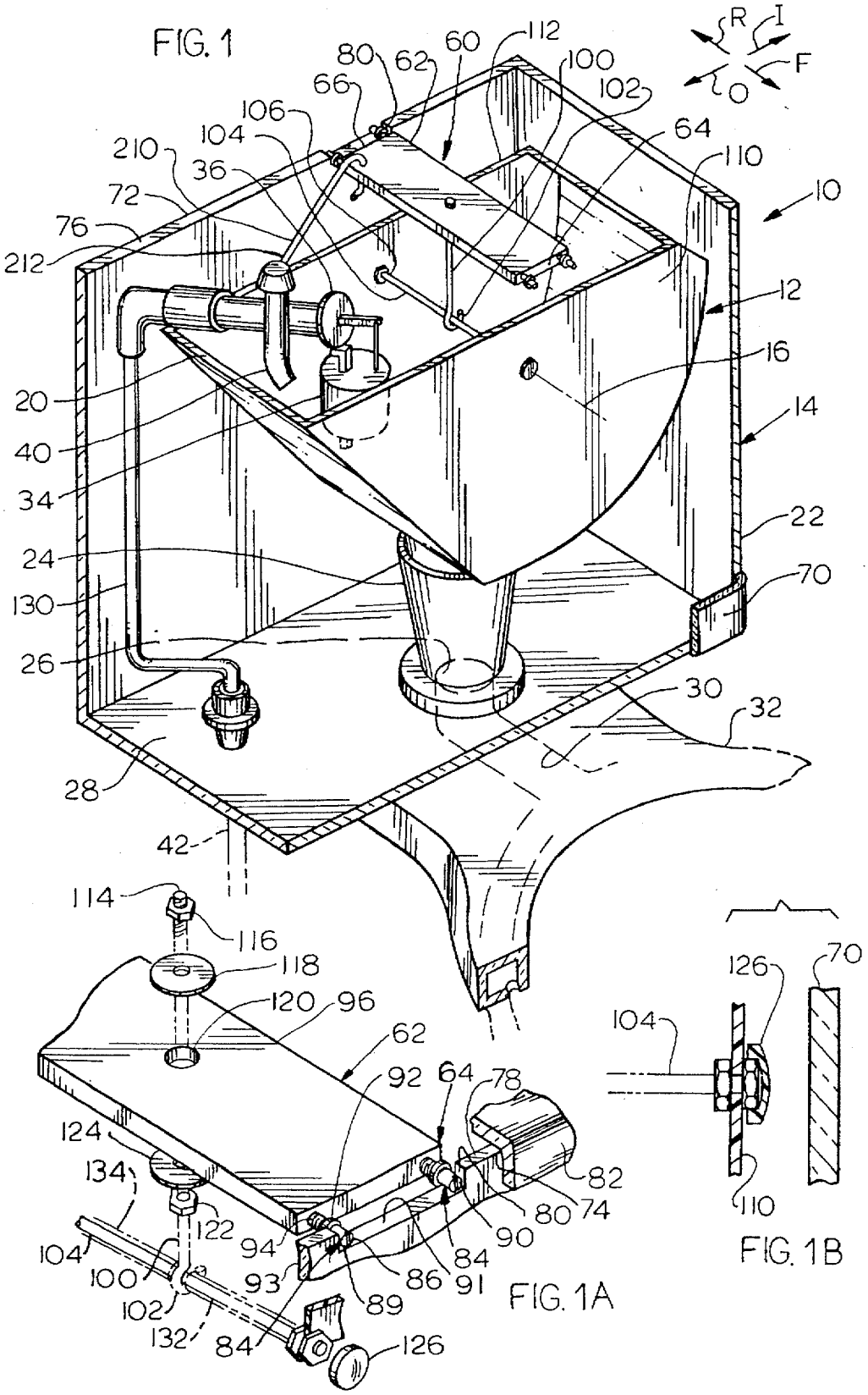
FIG. 1 is a partial isometric view of a dump bucket toilet constructed in accordance with the present invention.
FIG. 1A is an exploded isometric view of a portion of the bucket support of the toilet of FIG. 1.
FIG. 1B is a sectional view of a portion of the bucket support and tank of the toilet of FIG. 1A.

FIG. 1 illustrates a dump bucket toilet 10 which includes a dump bucket 12 that lies substantially completely within a container or toilet tank 14. It may be noted that an inner liner can lie within an outer tank or container to avoid sweating in cold areas, in which case the combination of liner and outside container is considered to be the tank. When the bucket is pivoted or tipped about a substantially horizontal axis 16, so that the upper outer end 20 of the bucket moves down, water stored in the bucket is released to flow into the lower portion 22 of the tank. The water flows through a funnel 24 and through an outlet 26 at the bottom of the tank at a lower wall 28 thereof, and along a water tunnel 30 to a toilet bowl 32, to flush the bowl. It may be noted that some toilets have urinal bowls rather than bowls designed to receive solid waste as well as liquid waste. When the bucket has tilted and is releasing its water, a float 34 on an inlet valve 36 senses this, and releases water through a nozzle 40, received from a city water supply pipe 42, to refill the bucket. Arrows F, R, I, O respectively indicate forward, rearward, inward, and outward directions.

Figure 2:
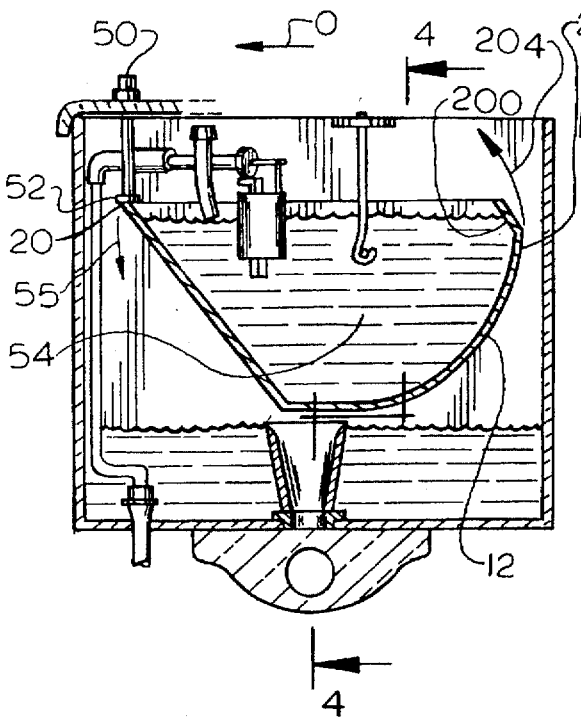
FIG. 2 is a sectional front view of the toilet of FIG. 1, with the bucket in its initial position.
Figure 3:
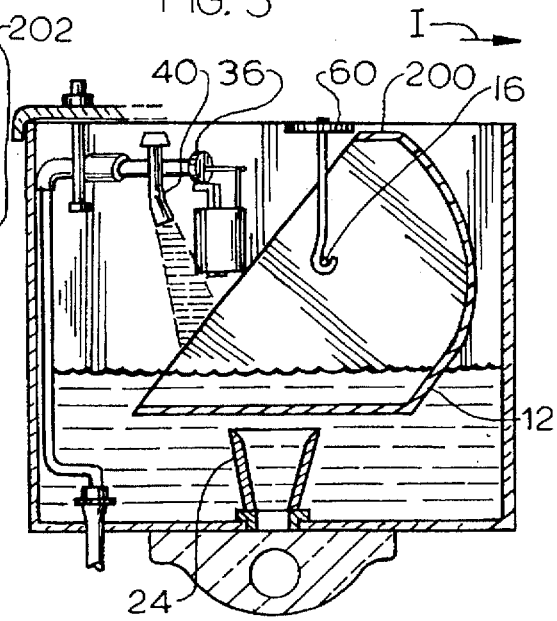
FIG. 3 is a view similar to that of FIG. 1, but with the bucket in its full release position.

In the particular toilet shown in FIG. 2, the bucket 12 is tilted from its initial position by a person depressing a button 50 to move down a post lower end 52 to initially move down the bucket upper outer end 20. The momentum of the pivoting bucket tends to keep it pivoting, and as the bucket pivots the stored water 54 shifts outwardly and urges the bucket to continue to pivot so its end 20 moves along the path 53. FIG. 3 shows the bucket in its full release position, wherein it has released most water which will flow to the toilet bowl. The inlet valve 36 is open and the nozzle 40 is releasing water to the bowl. The nearly empty bucket 12 in its full release position, has a center of gravity lying inward of the axis 16, so the bucket pivots back to its initial position. As the bucket fills, the center of gravity of the bucket walls and water therein continues to lie slightly inward of the pivot axis, which keeps the bucket in its initial position.

The bucket 12 (FIG. 1) is pivotally mounted on the tank 14 by a bucket support 60 which is of low cost and which can be very easily mounted on the tank, with the bucket hanging therefrom. The bucket support includes a mount portion 62 with front and rear ends 64, 66 mounted respectively on front and rear tank walls 70, 72. As shown in FIGS. 1 and 1A, the front and rear walls each have a tank top edge 74, 76 with a largely upwardly-facing surface thereat. Each end 64, 66 of the mount portion of the bucket support lies on the largely upwardly-facing surface 78 at a corresponding tank top edge such as 74. Applicant prefers to provide a cutout 80 at the top of the front and rear tank walls to accommodate the mount front ends such as 64, to provide proper seating for the toilet tank lid 82. For the particular mount portion 62, each end such as end 64 includes a pair of members 84, 86 with projecting ends 90. The ends 90 each have a downwardly-facing surface 89 that rests on a recessed upper edge portion 91 of the tank wall upper surface 78 at a corresponding cutout. Each member has a flange 92 that substantially abuts the inside surface 93 of the tank wall. Each member has a threaded shank 94 that screws into a threaded hole in a plate 96 of the mount portion, to allow the members 84, 86 to be moved so the flanges 92 fit closely against the tank front or rear wall. It may be noted that it is possible for the mount portion 62 to extend between the left and right, or outer and inner opposite tank walls, although this would require a longer and sturdier mount portion.

The bucket support 60 also includes a downwardly extending support portion 100 whose lower end 102 pivotally supports a rod 104. The rod 104 extends between front and rear walls 110, 112 of the bucket and is preferably fixed thereto. The rod 104 extends substantially along the axis 16 of pivoting of the bucket. As shown in FIG. 1A, applicant prefers to couple the upper end 114 of the bar that forms the support portion 100, so the upper end can be shifted up and down as well as forward and rearward and inwardly and outwardly. Up and down movement is accomplished by a nut 116 (and lock washer, not shown) which presses against a large washer 118 that lies over a large hole 120 in the plate 96. Another nut 122 presses against another large washer 124. The hole 120 allows the bar 100 to be moved slightly forward or rearward, before the nuts 116, 122 are tightened, to assure that the sides of the dump bucket do not rub against the front and rear tank walls. As shown in FIG. 1B, applicant prefers to provide a cap 126 of low friction material such as NYLON at the end of the rod 104, so that any rubbing of the bucket front or rear against the tank wall, results in minimal friction and wear.

The present dump bucket toilet can use a tank 14 (FIG. 1) of present design that holds about 5 gallons of water, preferably with a modification to leave cutouts 80 at the top edges of the front and rear tank walls. Also, a special pipe 130 is used to support the inlet valve 36 in the position shown. The bucket support 60 and bucket 12 are installed by merely lowering them into and onto the tank 14. In a particular illustrated embodiment (FIG. 1A), the members 84 at the end of the mount portion 62 are adjusted for the width of the top of the particular tank (which may vary by perhaps one-half inch for tanks of the same model). Also, one of the nuts 116 may be loosened and the bar 100 shifted to center the bucket in a forward and rearward directions within the tank. It may be noted that applicant may add tubes indicated at 132, 134 to keep the lower end 102 of the bar centered along the rod 104, or the rod 104 can be provided with protrusions to keep the rod centered on the bar 100.

Applicant prefers to use a single support portion in the form of the bar 100 to pivotally support the dump bucket. Sometimes the toilet is installed so the mount portion 62 will not extend horizontally, but with, for example, its front 64 slightly higher than its rear 66. By having a single rod 100 to support the middle of the bucket at its rod 104, the bucket is able to tilt to remain upright. If, on the other hand, the opposite ends of the rod 104 were each pivotally supported, then the bucket pivot axis would tilt along with any angling from plumb of the toilet tank. The tank would then tend to shift forward or rearward and increase friction. It is possible to largely fix the bar 100 to the rod 104 and have opposite ends of the bar pivotally connected to the bucket, but this is usually more expensive.

Figure 4:
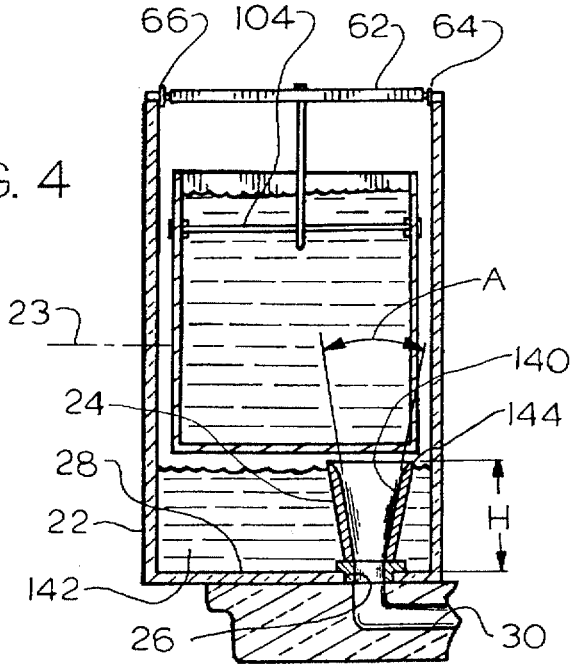
FIG. 4 is a view taken on line 4—4 of FIG. 2.

As shown in FIG. 4, when the toilet is in its initial position, the lower portion 22 of the tank (which lies below the middle 23), is filled with water to a height H between flushings, the height H being the height of the funnel 24. The funnel 24 has an inside funnel surface 140 which is tapered so it has an included angle A of about 14° along at least 75% of the height of the funnel, with the angle being between 8° and 20° and more preferably between 11° and 17°. The height H is at least about four inches (three inches or more), and is preferably between five and six inches. Applicant finds that such a funnel directs water at high velocity into the water tunnel 30 that leads to the toilet bowl. The pool 142 of water that remains between flushings lies substantially even with the top 144 of the funnel. Since there is no valve seat against which a flush member must seal and across which water must flow, there is a laminar flow into the funnel. Applicant has experimented and found that the above described dimensions provide the best flushings for a toilet of the illustrated construction wherein the dump bucket holds 1.7 gallons to dispense 1.6 gallons of water in each flushing (about 8 ounces remains behind). The efficiency of a flushing is judged by the number of small articles of different densities (some float and some sink) that are moved out of the toilet bowl in one flushing.

Figure 5:
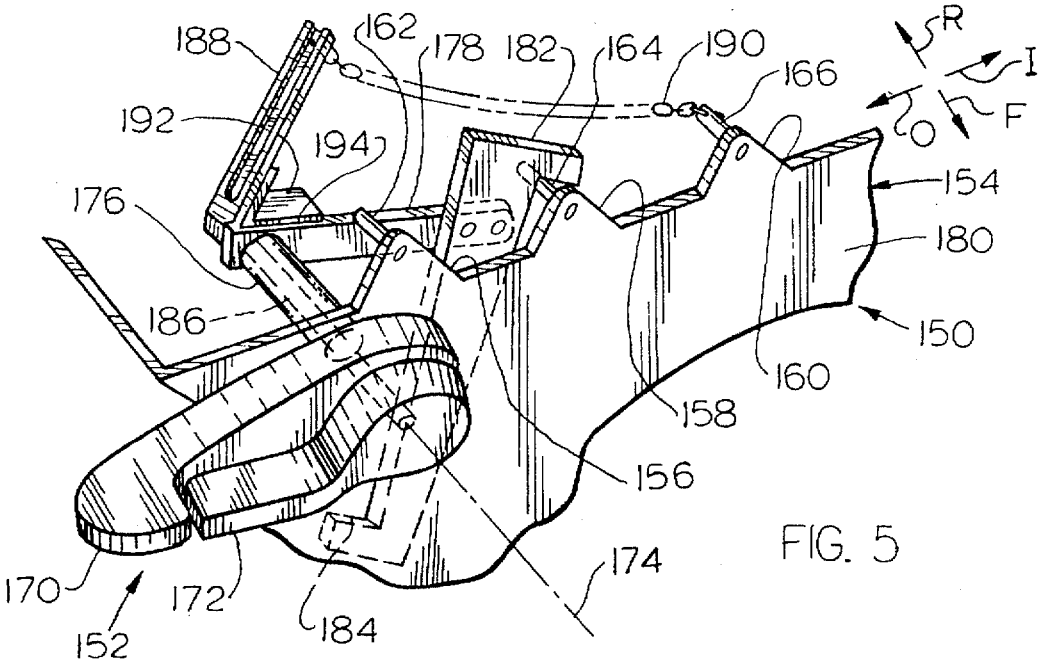
FIG. 5 is a partial isometric view of a dump bucket toilet constructed in accordance with another embodiment of the invention, and showing the manually operable control that permits a partial flush.
Figure 8:
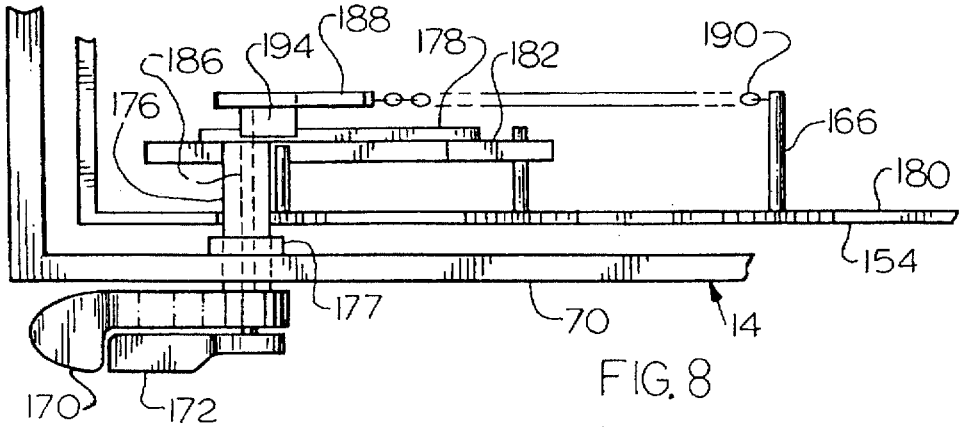
FIG. 8 is a plan view of a portion of the toilet of FIG. 5.

Although the dump bucket toilet of FIGS. 1–4 provides a good flushing using only 1.6 gallons, or 6 liters of water, even more water can be saved. FIG. 5 shows a portion of another dump bucket toilet 150 which is similar to that of FIGS. 1–4, except that it includes a manually operable control 152 designed to enable even less water to be used under certain circumstances. The bucket 154 is modified to have three holder parts 156, 158, 160 that hold three corresponding projections 162, 164, 166. The control 152 includes a first or full flush lever 170 and a second or partial flush lever 172, that are separately pivotally mounted about a handle axis 174. The first lever 170 is fixed to a tube 176 that is pivotally mounted on a bearing 177 (FIG. 8) on the tank front wall 70, and carries a bar 178 that lies rearward of the bucket front wall 180. The bar carries a stop member 182 with a stop 184 at its lower end shown in a block position in FIG. 5. The partial flush lever 172 is fixed to a shaft 186 that extends through the tube 176 and that is fixed to an activator 188. The activator 188 is connected by a chain device 190 to the projection 166.

Figure 6:
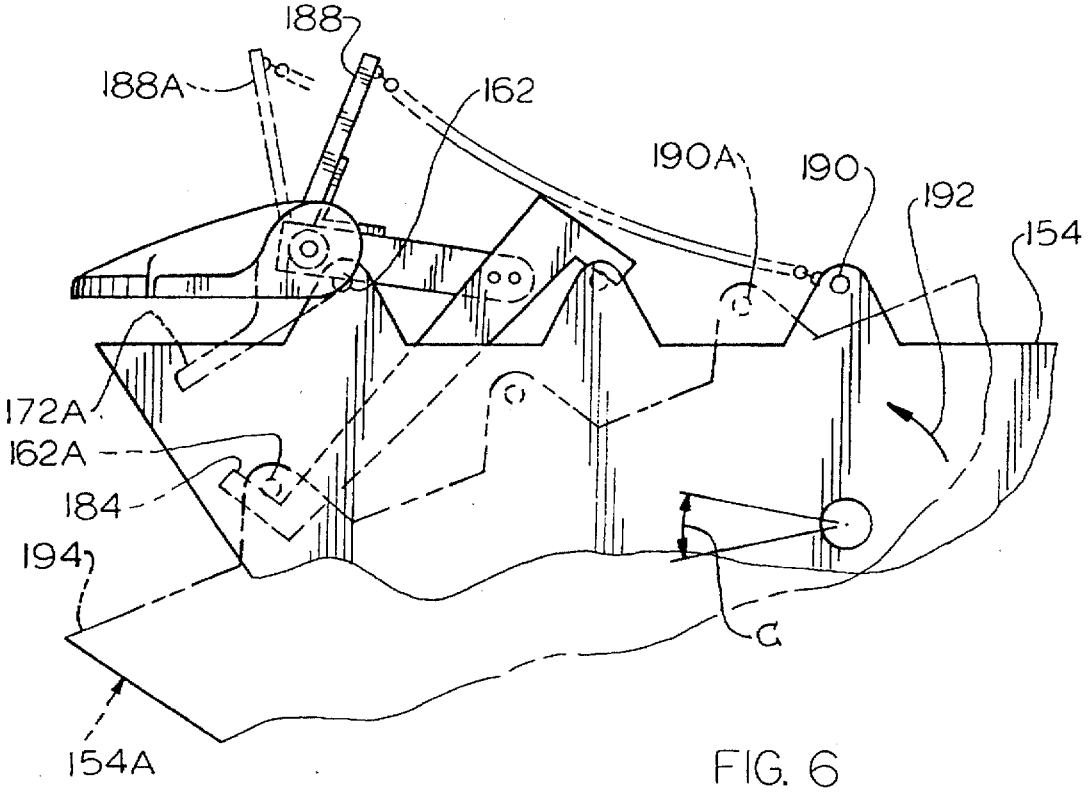
FIG. 6 is a partial front elevation view of the toilet of FIG. 5 and showing, in phantom lines, the bucket in its partial release position.

When a person depresses the partial flush lever 172 to the position 172A in FIG. 6, the actuator 188 moves to the position 188A. The projection 190 on the bucket moves to the position 190A, causing the bucket to tilt or pivot in a first direction 192 to the partial release position 154A. As the bucket pivots, the bucket projection 162 reaches the position 162A, wherein it hits the stop 184, which prevents any further pivoting of the bucket in the first direction. When the bucket has reached the position 154A, roughly half (usually 25% to 75%) of the total amount of water to be released in the full flush position, is released from the bucket. The released water spills over the upper outer end 194 of the bucket into the tank to flow to the toilet bowl. Normally, the lever at 172A is immediately released, and the bucket returns to its original position 154 due to the center of gravity of the remaining water tending to pivot the bucket back after water stops flowing out.

Figure 7:
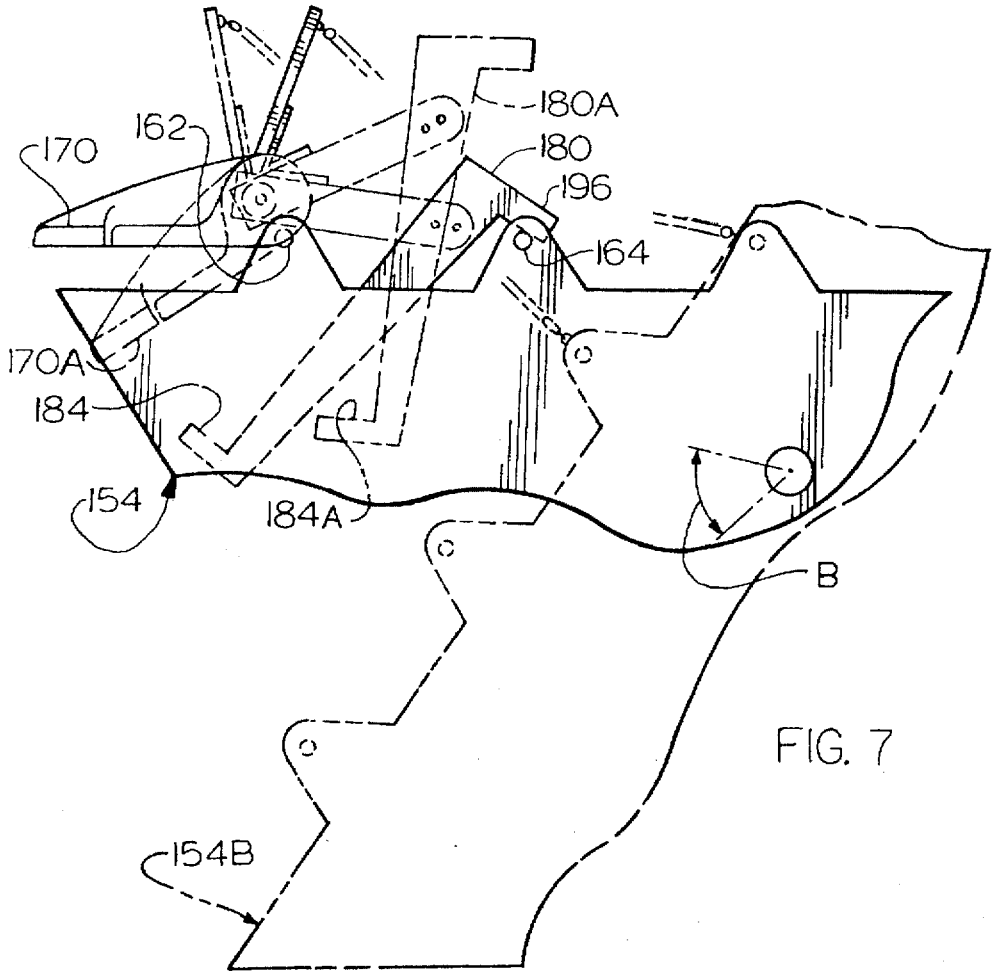
FIG. 7 is a view similar to that of FIG. 6 but showing, in phantom lines, the bucket in its full flush position.

FIG. 7 shows the full flush handle 170 moved down to the position 170A. As shown in FIG. 5, the bar 178 that is fixed to the full flush lever 170 has a pusher part 194 that can press up against a part 192 of the actuator 188. As a result, when the full flush lever and bar 178 pivot, the pusher part 194 pushes against the actuator part 192, which causes the actuator 188 and the partial flush lever to pivot. This causes the chain device 190 to pivot the bucket towards a full flush position as the full flush lever 170 is depressed.

As shown in FIG. 7, as the full flush lever 170 pivots to the position 170A, it causes the stop member 180 to pivot to the position 180A. This results in the stop which is initially at position 184, to pivot to the position 184A wherein it is out of the path of the projection 162. This allows the bucket to pivot by a large first angle B to a full flush position 154B at which almost all of the water in the bucket is released. With the water released, the bucket pivots back towards its initial position 154. By then, the full flush lever 170 will have been released to its original position, and the projection 164 will abut an upper part 196 of the stop member 180, which assures that the bucket will not pivot back much past its initial position.

As shown in FIG. 2, the bucket has an upper inward end portion 200 of more than one inch length, which extends at an upward-outward incline, instead of being a continuation of portion 202 that lies immediately below the portion 200. As the upper outward end 20 moves along path 55 which has a downward directional component, the inner upper end portion 200 moves along path 204 which has an upward directional component. As shown in FIG. 3, the reason for the upper inner end portion 200, is to limit the height to which the inner end of the bucket rises when the bucket moves to its full flush, or full release position. In the full release position, the bucket portion 200 extends primarily horizontally. If desired, the mount portion 60 of the bucket support can be used to stop pivoting of the bucket past its full release position. Applicant has constructed and tested dump bucket toilets of the constructions shown in FIGS. 1–8, with buckets having an inward-outward length of about 16 inches and found them to provide efficient flushings.

FIG. 1 shows a refill hose 210 extending from a refill outlet 212 of the inlet valve 36. After each flushing, the inlet valve dispenses water to refill the toilet bowl. Applicant mounts the refill tube on the mount portion 62 of the support, with the end of the hose positioned to direct water at a side 72 of the tank to trickle down the side and into the lower portion of the tank to flow out the funnel 24 to the toilet bowl.

Thus, the invention provides a dump bucket toilet with a bucket support, usually supplied a bucket thereon, which is of low cost and which can be easily and reliably mounted on a container or tank and which reliably pivotally supports the bucket, as well as providing a partial flush mechanism and an efficient conduit for carrying water out of the tank. The bucket support has a mount portion with opposite ends mounted on top edges of opposite walls of the tank. A support portion depending from the mount portion, preferably pivotally supports the middle of a rod that extends substantially along the pivot axis of the bucket. A manually operable control is operable in a partial-flush mode to pivot the bucket by an angle less than that achieved for a full flush, to save water. A funnel is preferably provided that extends up from the bottom of the tank by a height of at least four inches and which is tapered with an included angle of about 14°, to efficiently carry water that is suddenly dumped. Water is contained at the bottom of the tank to the height of the top of the funnel.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A dump bucket toilet which includes a toilet bowl, a tank having opposite tank walls and upper and lower portions, said opposite tank walls each having a top edge with a largely upwardly-facing surface and said tank having an outlet in said lower portion which is coupled to said toilet bowl to flow water thereto, a dump bucket which can pivot about a primarily horizontal pivot axis to tip and release water into said tank so the released water can flow out through said outlet, and an inlet valve positioned to refill said bucket, characterized by:

a bucket support that includes a mount portion having opposite ends each mounted on said tank upper portion at a location above said pivot axis, said bucket support having a support portion which extends downwardly from said mount portion and which supports said bucket in pivoting about said axis, with said support portion being stationary when said toilet is in use and said bucket pivots as well as when said toilet is not in use and said bucket does not pivot;

each of said mount portion ends rests on one of said tank top edges at one of said largely upwardly-facing surfaces thereat.

2. Apparatus for use in a dump bucket toilet that includes a tank with front and rear tank walls that each have an upper end portion with an upper edge, said tank also having a lower portion, comprising:

a bucket having a horizontal pivot axis;

a support constructed to mount on said tank, said support having a mount portion with front and rear ends that each have a downwardly-facing surface for resting on a corresponding one of said upper end portions of said tank walls, and said support having a primarily downwardly-extending support portion with a lower end which is pivotally connected to said bucket to support said dump bucket in pivoting about said pivot axis, with said support being stationary during use of the toilet when said dump bucket pivots.

3. A dump bucket toilet which includes a toilet bowl, a tank having upper and lower portions and having an outlet in said lower portion which is coupled to said toilet bowl to flow water thereto, a bucket which lies at least primarily in said tank and which is pivotally mounted about a horizontal axis to pivot from an initial position in a first direction to dump water for exit through said outlet and in an opposite direction back to said initial position, and an inlet valve positioned to refill said bucket, characterized by:

a manually operable control which is operable in a first full-flush mode to pivot said bucket in said first direction from said initial position, by a first angle, to release almost all water from said dump bucket;

said manually operable control being operable in a second partial-flush mode to pivot said dump bucket in said first direction from said initial position, by a second angle which is less than said first angle, to a partial release position to release less water than when pivoted to said full release position;

said manually operable control including a stop which is positioned in the path of pivoting of said dump bucket in said first direction from said initial position to stop pivoting of said bucket by more than said second angle, when said control is operated in said second mode, but which is positioned out of the path of said bucket when said control is operated in said first mode.

4. The toilet described in claim 3 wherein:

said manually operable control includes first and second levers that are each pivotable about a corresponding handle axis;

said stop is connected to said first lever so when said first handle is pivoted about its handle axis said stop is moved from an initial stop position out of the path of said dump bucket, but so when only said second handle is pivoted about its handle axis said stop remains in its initial stop position and prevents pivoting of said bucket by more than said second angle.

5. The toilet described in claim 4 wherein:

said handle axes of said first and second levers are substantially coincident and are each pivotable in a flushing direction and an opposite direction; and including a chain device connecting said second lever to said dump bucket so pivoting of said second lever in a flushing direction pivots said bucket in said first direction;

said first lever includes a pusher part that is positioned to push said second lever to pivot it in said flushing direction when said first lever is pivoted in said flushing direction, with said second lever moving away from said pusher part when only said second lever is pivoted in said flushing direction.

6. A dump bucket toilet which includes a toilet bowl, a tank having opposite tank walls and upper and lower portions, said opposite tank walls each having a top edge with a largely upwardly-facing surface and said tank having an outlet in said lower portion which is coupled to said toilet bowl to flow water thereto, a dump bucket which can pivot about a primarily horizontal pivot axis to tip and release water into said tank so the released water can flow out through said outlet, and an inlet valve positioned to refill said bucket, characterized by:

a bucket support that includes a mount portion having opposite ends each mounted on said tank upper portion at a location above said pivot axis and having a largely downwardly extending support portion which supports said bucket in pivoting about said axis;

each of said mount portion ends rests on one of said tank top edges at one of said largely upwardly-facing surfaces thereat;

each of said opposite walls of said tank has an upper edge portion that is substantially straight, but with a cutout forming a recessed upper edge portion, and a respective one of each of said mount portion ends lies in a respective one of said cutouts.

7. A dump bucket toilet which includes a toilet bowl, a tank having opposite tank walls and upper and lower portions, said opposite tank walls each having a top edge with a largely upwardly-facing surface and said tank having an outlet in said lower portion which is coupled to said toilet bowl to flow water thereto, a dump bucket which can pivot about a primarily horizontal pivot axis to tip and release water into said tank so the released water can flow out through said outlet, and an inlet valve positioned to refill said bucket, characterized by:

a bucket support that includes a mount portion having opposite ends each mounted on said tank upper portion at a location above said pivot axis and having a largely downwardly extending support portion which supports said bucket in pivoting about said axis;

each of said mount portion ends rests on one of said tank top edges at one of said largely upwardly-facing surfaces thereat;

said inlet valve has a refill outlet conduit which directs water to a lower portion of said tank, to flow out of said outlet.

8. A dump bucket toilet which includes a toilet bowl, a tank having opposite tank walls and upper and lower portions, said opposite tank walls each having a top edge with a largely upwardly-facing surface and said tank having an outlet in said lower portion which is coupled to said toilet bowl to flow water thereto, a dump bucket which has front and rear bucket sides and which can pivot about a primarily horizontal pivot axis to tip and release water into said tank so the released water can flow out through said outlet, and an inlet valve positioned to refill said bucket, characterized by:

a bucket support that includes a substantially stationary mount portion having opposite ends each mounted on said tank upper portion at a location above said pivot axis, said bucket support having a substantially stationary support portion which extends downwardly from said mount portion and which supports said bucket in pivoting about said axis;

each of said mount portion ends rests on one of said tank top edges at one of said largely upwardly-facing surfaces thereat;

a rod extending substantially along said pivot axis through said bucket between said bucket sides;

said support portion comprises a member having a lower end that is pivotally connected to said rod at a position halfway between said bucket sides.

9. Apparatus for use in a dump bucket toilet that includes a tank with front and rear tank walls that each have an upper end portion with an upper edge, said tank also having a lower portion, comprising:

a bucket having a horizontal pivot axis, and having front and rear bucket sides and a rod extending between said sides;

a support constructed to mount on said tank, said support having a mount portion with front and rear ends that each have a downwardly-facing surface for resting on a corresponding one of said upper end portions of said tank walls, and said support having a primarily downwardly-extending substantially stationary support portion with a lower end which is pivotally connected to said bucket to support said dump bucket in pivoting about said pivot axis while preventing movement of said bucket other than in pivoting about said pivot axis;

said support portion comprises a member having a lower end that is pivotally connected to said rod at a location halfway between said sides of said bucket.

10. A dump bucket toilet which includes a toilet bowl, a tank having opposite tank walls and upper and lower portions with said lower portion forming a lower wall with an outlet extending therethrough, said opposite tank walls each having a top edge with a largely upwardly-facing surface and said outlet being coupled to said toilet bowl to flow water thereto, a dump bucket which can pivot about a primarily horizontal pivot axis to tip and release water into said tank so the released water can flow out through said outlet, and an inlet valve positioned to refill said bucket, characterized by:

a bucket support that includes a mount portion having opposite ends each resting on one of said tank top edges at one of said largely upwardly-facing surfaces thereat at a location above said pivot axis, said bucket support having a support portion which extends downwardly from said mount portion and which supports said bucket in pivoting about said axis, with said support portion being substantially stationary when said toilet is in use and said bucket pivots as well as when said toilet is not in use and said bucket does not pivot;

a funnel having a lower end coupled to said outlet of said tank and having an always open upper end extending at least four inches above said lower wall;

said tank holding water of a height of at least four inches above said lower wall and up to the level of the top of said funnel, between flushings;

said dump bucket being positioned to dump water into said tank only at a location spaced from said funnel.

11. A dump bucket toilet which includes a toilet bowl, a tank having opposite tank walls and upper and lower portions, said opposite tank walls each having a top edge with a largely upwardly-facing surface and said tank having an outlet in said lower portion which is coupled to said toilet bowl to flow water thereto, a dump bucket which can pivot about a primarily horizontal pivot axis to tip and release water into said tank so the released water can flow out through said outlet, and an inlet valve positioned to refill said bucket, characterized by:

a bucket support that includes a mount portion having opposite ends each mounted on said tank upper portion at a location above said pivot axis, said bucket support having a support portion which extends downwardly from said mount portion and which supports said bucket in pivoting about said axis with said support portion being substantially stationary when said toilet is in use and said bucket pivots as well as when said toilet is not in use and said bucket does not pivot;

each of said mount portion ends rests on one of said tank top edges at one of said largely upwardly-facing surfaces thereat;

said dump bucket has an upper outward end which moves with a downward directional component when said bucket pivots in a first direction to release water at the beginning of a flushing, and has an inner upper end portion that moves with an upward directional component when said bucket pivots in said first direction, said bucket being pivotable by a maximum of a first angle to a full release position to release almost all water from said bucket;

said bucket inner upper end portion is primarily straight and has a length of at least one inch and is angled to extend primarily horizontally when said bucket lies in said full release position.

12. Apparatus for use in a dump bucket toilet that includes a tank with front and rear tank walls that each have an upper end portion with an upper edge, said tank also having a lower portion, comprising:

a bucket having a horizontal pivot axis;

a support constructed to mount on said tank, said support having a mount portion with front and rear ends that each have a downwardly-facing surface for resting on a corresponding one of said upper end portions of said tank walls, and said support having a primarily downwardly-extending support portion with a lower end which is pivotally connected to said bucket to support said dump bucket in pivoting about said pivot axis, with said support being substantially stationary during use of the toilet when said dump bucket pivots;

said mount portion has at least one abutment positioned to abut one of said tank walls;

said abutment is fixable in each of a plurality of positions spaced in a direction parallel to said pivot axis.

13. Apparatus for use in a dump bucket toilet that includes a tank with front and rear tank walls that each have an upper end portion with an upper edge, said tank also having a lower portion, comprising:

a bucket having a horizontal pivot axis;

a support constructed to mount on said tank, said support having a mount portion with front and rear ends that each have a downwardly-facing surface for resting on a corresponding one of said upper end portions of said tank walls, and said support having a primarily downwardly-extending support portion with a lower end which is pivotally connected to said bucket to support said dump bucket in pivoting about said pivot axis, with said support being substantially stationary during use of the toilet when said dump bucket pivots;

said dump bucket has outer upper and inner upper end portions with said inner upper end portion rising when said bucket is tilted to dispense water and with said outer upper end portion extending substantially horizontal in a fully tilted position of said bucket, with said inner end portion being angled to extend substantially horizontally along a distance of at least one inch when said bucket is in said fully tilted position.

14. A dump bucket toilet which includes a toilet bowl, a tank having an inside, a lower wall with an outlet, a largely horizontal water tunnel extending between said outlet and said toilet bowl, a bucket pivotally mounted in said tank, and an inlet valve positioned to refill said bucket, characterized by:

a funnel having a lower end aligned with said tank outlet and having a wider upper end lying at least four inches above said tank lower wall, said funnel having a vertical axis with said funnel having a top that is continually open to the inside of said tank without any barrier to an unimpeded laminar flow of water dumped into said tank, into and down along said funnel;

said bucket being pivotally mounted to release water into a region of said tank that lies beside said funnel rather than into said funnel;

said funnel has a height of about 5½ inches and said funnel has inner funnel walls that form an included angle of between 8° and 20° along at least 75% of the height of said funnel with said inner funnel walls being substantially devoid of steps that could interfere with laminar flow therealong.

* * * * *